US010096298B2

(12) United States Patent
Wang

(10) Patent No.: US 10,096,298 B2
(45) Date of Patent: Oct. 9, 2018

(54) DISPLAY DEVICE AND CONTROL METHOD THEREOF

(71) Applicant: EVERDISPLAY OPTRONICS (SHANGHAI) LIMITED, Shanghai (CN)

(72) Inventor: Huannan Wang, Shanghai (CN)

(73) Assignee: EverDisplay Optronics (Shanghai) Limited, Shanghai (CN)

( * ) Notice: Subject to any disclaimer, the term of this patent is extended or adjusted under 35 U.S.C. 154(b) by 25 days.

(21) Appl. No.: 15/237,766

(22) Filed: Aug. 16, 2016

(65) Prior Publication Data

US 2017/0316755 A1 Nov. 2, 2017

(30) Foreign Application Priority Data

Apr. 29, 2016 (CN) ..... 2016 1 0281539

(51) Int. Cl.
*G09G 5/10* (2006.01)

(52) U.S. Cl.
CPC ..... *G09G 5/10* (2013.01); *G09G 2310/0208* (2013.01); *G09G 2310/0286* (2013.01); *G09G 2310/06* (2013.01); *G09G 2310/08* (2013.01); *G09G 2320/0626* (2013.01)

(58) Field of Classification Search
CPC ..... G09G 5/10; G09G 2310/0298; G09G 2310/0286; G09G 2310/06; G09G 2310/08
See application file for complete search history.

(56) References Cited

U.S. PATENT DOCUMENTS

2011/0285752 A1* 11/2011 Park ..... G09G 3/3225 345/690
2013/0002615 A1* 1/2013 Kang ..... G09G 3/3266 345/204
2013/0002630 A1* 1/2013 Lee ..... G09G 3/3266 345/211

* cited by examiner

*Primary Examiner* — Ariel Balaoing
(74) *Attorney, Agent, or Firm* — Yunling Ren

(57) ABSTRACT

A display device includes a pixel array, a scan driving unit, a light emitting driving unit and a light emitting switch unit. The scan driving unit is configured to provide a scan signal to the pixel array, the light emitting driving unit is configured to provide a light emitting signal to the pixel array, and the light emitting switch unit is configured to provide a switch signal to the pixel array, wherein the display device performs a progressive displaying when the light emitting driving unit is enabled and performs a simultaneous displaying when the light emitting switch unit is enabled.

10 Claims, 28 Drawing Sheets

DISPLAY DEVICE AND CONTROL METHOD THEREOF

CROSS REFERENCE

This application is based upon and claims priority to Chinese Patent Application No. 201610281539.8, filed on Apr. 29, 2016, the entire contents thereof are incorporated herein by reference.

TECHNICAL FIELD

The present disclosure relates to the field of display technologies, and more particularly, to a display device and a control method thereof.

BACKGROUND

With respect to general display devices, there are generally two types of display means, i.e., progressive displaying and simultaneous displaying.

Generally, known display devices may only use progressive displaying. FIGS. 1 and 2 illustrate schematic diagrams of the components of the progressive displaying display devices in the prior art. A display device 100 includes a pixel array 11, a scan driving unit 12, a data driving unit 13 and a light emitting driving unit 14. The scan driving unit 12 provides a scan signal to the pixel array 11 via scan lines, the data driving unit 13 provides a data signal to the pixel array 11 via data lines, and the light emitting driving unit 14 provides a light emitting control signal to the pixel array 11 via control lines. The pixel array 11 corresponds to a central region of the display device and forms a display region. The pixel array 11 includes a plurality of pixels arranged in matrix. Each of the pixels corresponds to a switch transistor having a control terminal (i.e., a gate electrode) connected to the scan line, a first terminal (i.e., a source electrode) connected to the data line and a second terminal (i.e., a drain electrode) connected to the pixel. In FIG. 1, scan driving units 12 are provided at both sides of the pixel array 11, and light emitting driving units 14 are provided at the periphery of the scan driving units 12, respectively. In FIG. 2, scan driving units 12 are also provided at both sides of the pixel array 11, while the light emitting driving unit 14 is only provided at the periphery of one of the scan driving units 12.

For example, the display device illustrated in FIG. 1 or FIG. 2 performs a progressive displaying. The scan driving unit 12 charges the pixels in the pixel array 11 progressively in a top-down order or a down-top order, and the light emitting driving unit 14 turns on the light emitting switches of the pixels in the pixel array 11 progressively in a top-down order or a down-top order, such that the pixels in the pixel array emit light progressively and display an image.

However, in the structure illustrated in FIG. 1 and FIG. 2, progressive displaying is incompatible with the simultaneous displaying, and thus it fails to satisfy the demand of diversification.

SUMMARY

Some embodiments of the present disclosure provide a display device including a pixel array, and further including:

a scan driving unit configured to provide a scan signal to the pixel array;

a light emitting driving unit configured to provide a light emitting signal to the pixel array; and a light emitting switch unit configured to provide a switch signal to the pixel array, wherein the display device performs a progressive displaying when the light emitting driving unit is enabled and performs a simultaneous displaying when the light emitting switch unit is enabled.

Other embodiments of the present disclosure provide a method for controlling the above display device, the method including:

providing a scan signal from a scan driving unit to the pixel array;

providing a light emitting signal from a light emitting driving unit to the pixel array;

providing a switch signal from a light emitting switch unit to the pixel array; and wherein the display device performs a progressive displaying when the light emitting driving unit is enabled and performs a simultaneous displaying when the light emitting switch unit is enabled.

BRIEF DESCRIPTION OF THE DRAWINGS

The above and other features and advantages of the present disclosure will become more apparent by describing example embodiments of the present disclosure in detail with reference to the drawings.

DETAILED DESCRIPTION

Typical embodiments showing features and advantages of the present disclosure will be described in detail in the following description. It should be appreciated that the present disclosure may involve various changes in different embodiments without departing from the scope of the present disclosure. In addition, the descriptions and drawings herein are provided essentially for illustration, rather than limiting the scope of the present disclosure.

In order to overcome the above problems, several embodiments are provided hereinafter to explain and illustrate the present disclosure.

Figure 1:
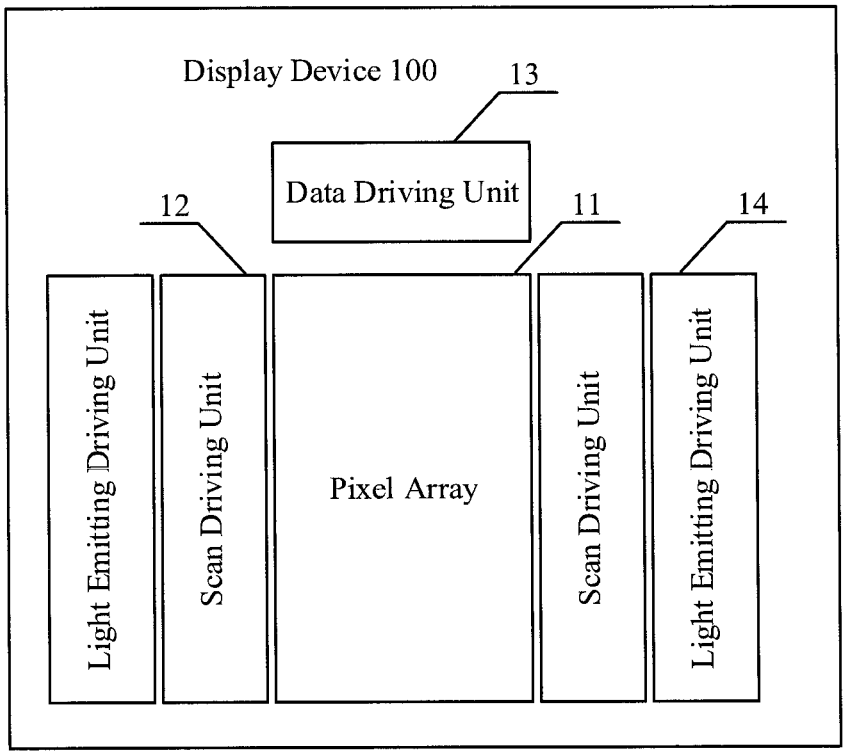
Fig. 1 (Prior Art)
FIG. 1 illustrates a schematic diagram of components of a display device in a related embodiment.
Figure 2:
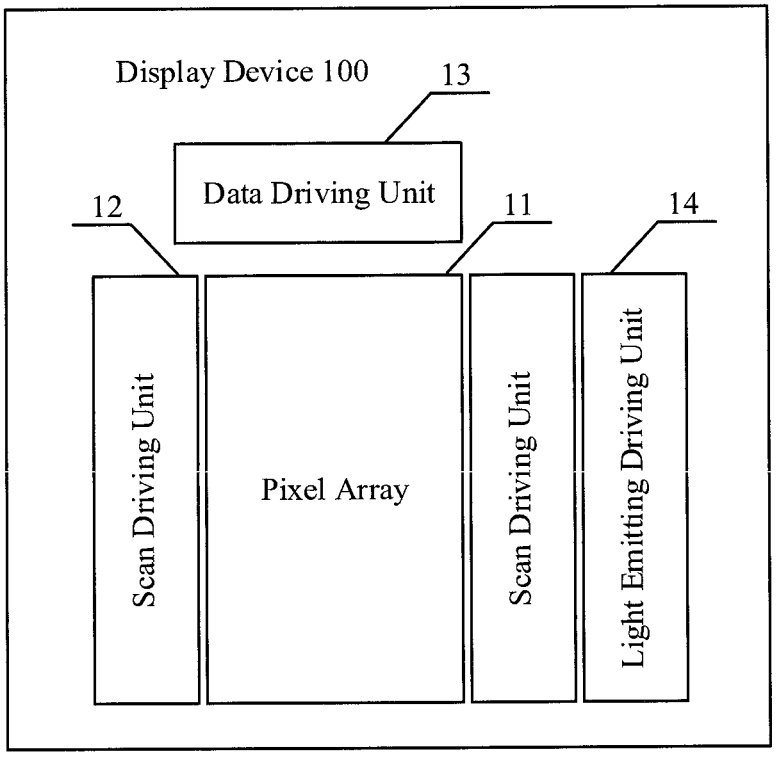
Fig. 2 (Prior Art)
FIG. 2 illustrates a schematic diagram of components of another display device in a related embodiment.
Figure 3:
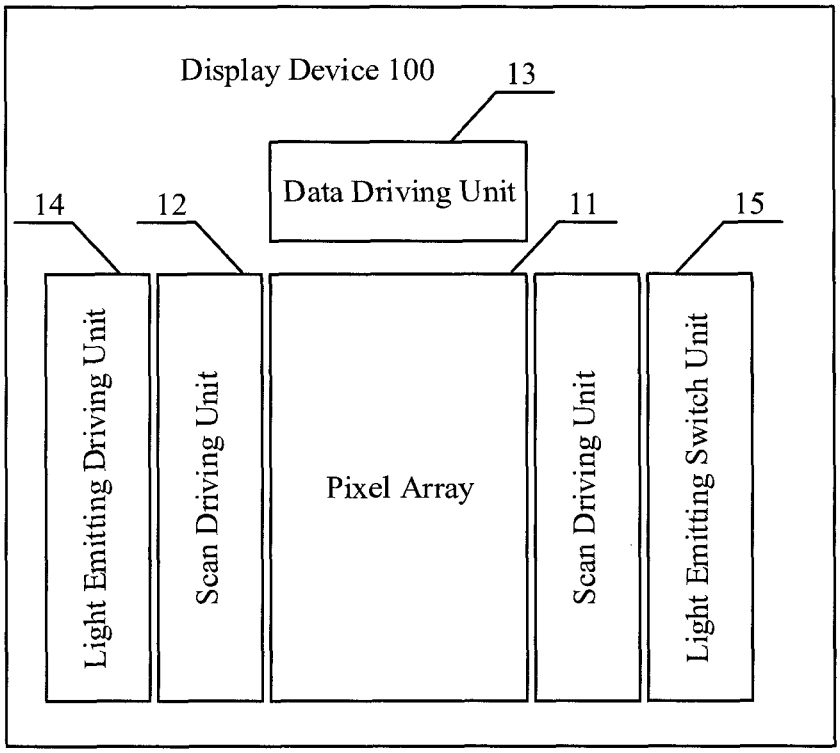
FIG. 3 illustrates a schematic diagram of components of a display device according to an embodiment of the present disclosure.
Figure 4:
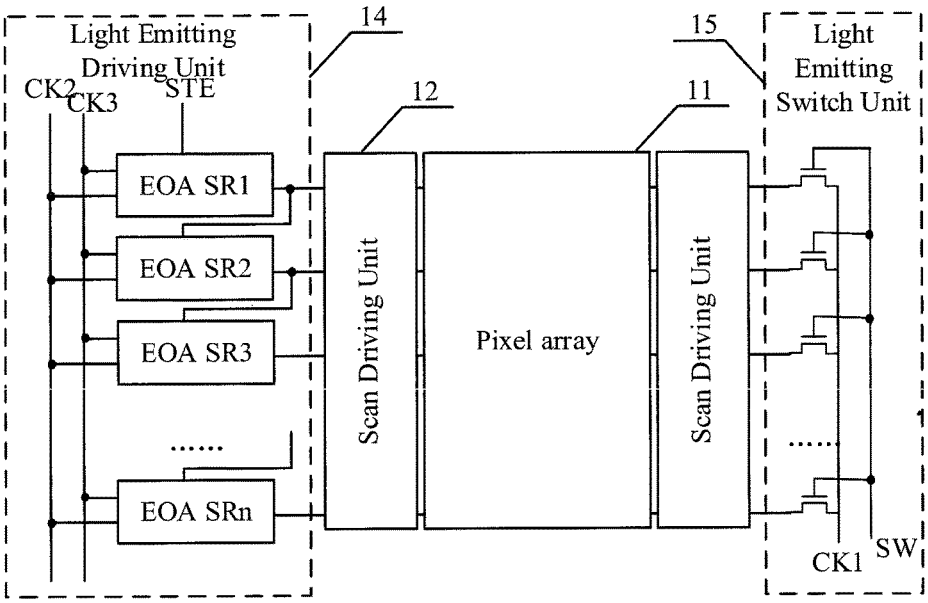
FIG. 4 illustrates a schematic diagram of a structure of a display device according to an embodiment of the present disclosure.

FIG. 3 illustrates a schematic diagram of a structure of a display device according to some embodiments of the present disclosure. As illustrated in FIG. 3, the display device 100 includes a pixel array 11, a scan driving unit 12, a light emitting driving unit 14 and a light emitting switch unit 15, wherein the scan driving unit is configured to provide a scan signal to the pixel array, the light emitting driving unit 14 is configured to provide a light emitting signal to the pixel array, and the light emitting switch unit 15 is configured to provide a switch signal to the pixel array, and wherein the display device performs a progressive displaying when the light emitting driving unit 14 is enabled, and performs a simultaneous displaying when the light emitting switch unit 15 is enabled. FIG. 4 illustrates a schematic diagram of a structure of a display device according to the present embodiment. The light emitting switch unit 15 includes a plurality of switch elements 151 each of which includes a first clock signal input terminal, a control signal input terminal and a first output terminal. A clock signal CK1 is provided to the first clock signal input terminal, and a control signal SW is provided to the control signal input terminal. The light emitting driving unit 14 includes a plurality of cascade connected shift register units SR1, SR2, . . . , SRn, each of which includes a second clock signal input terminal, a third clock signal input terminal, an initiating signal input terminal and a second output terminal, wherein the second output terminal is electrically coupled to the first output terminal. A clock signal CK2 is provided to the second clock signal input terminal, a clock signal CK3 is provided to the third clock signal input terminal, and an initiating signal STE is provided to the initiating signal input terminal.

Figure 5:
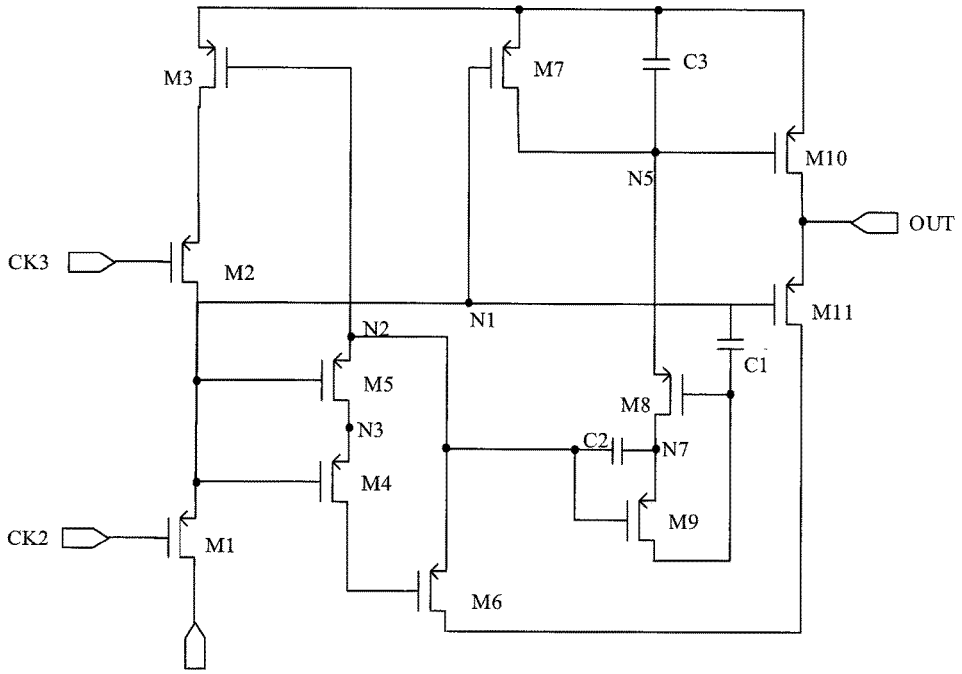
FIG. 5 illustrates a circuit diagram of an EOA SR according to an embodiment of the present disclosure.

The shift register unit SR of the present embodiment may be EOA (Emission on Array), i.e., may be an EOA SR. FIG. 5 illustrates a circuit diagram of the EOA SR according to the present embodiment. As illustrated in FIG. 5, the EOA SR includes a first transistor M1 to an eleventh transistor M11 and a first capacitor C1 to a third capacitor C3. Each transistor includes a first terminal, a second terminal and a control terminal. The first terminal of the transistor M1 is coupled with the second terminal of the terminal M2 (i.e., a first node N1) and the control terminals of the transistors M4 and M5, the second terminal of the transistor M1 is coupled with the initiating signal STE, and the control terminal of the transistor M1 is coupled with the clock signal CK2. The first terminal of the transistor M2 is coupled with the second terminal of the transistor M3, and the control terminal of the transistor M2 is coupled with the clock signal CK3. The first terminal of the transistor M3 is coupled with the first terminals of the transistors M7 and M10 and a first terminal of the capacitor C3, the control terminal of the transistor M3 is coupled with the first terminal of the transistor M5 (i.e., a second node N2). The first terminal of the transistor M4 is coupled with the second terminal of the transistor M5, and the second terminal of the transistor M4 is coupled with the control terminal of the transistor M6. The first terminal of the transistor M6 is coupled with the second node N2, a first terminal of the capacitor C2 and the control terminal of the transistor M9, and the second terminal of the transistor M6 is coupled with the second terminal of the transistor M11. The control terminal of the transistor M7 is coupled with the first node N1 and the control terminal of the transistor M11, and the second terminal of the transistor M7 is coupled with a fifth node N5 and the control terminal of the transistor M10. The first terminal of the transistor M8 is coupled with the fifth node N5, the second terminal of the transistor M8 is coupled with a seventh node N7 and a second terminal of the capacitor C2, and the control terminal of the transistor M8 is coupled with a second terminal of the capacitor C1 and the second terminal of the transistor M9. The first terminal of the transistor M9 is coupled with the seventh node N7. The second terminal of the transistor M10 and the first terminal of the transistor M11 are coupled with an output terminal OUT. It should be noted that the transistor in the present embodiment may be a PMOS transistor, and may also be an NOMOS transistor.

Figure 6:
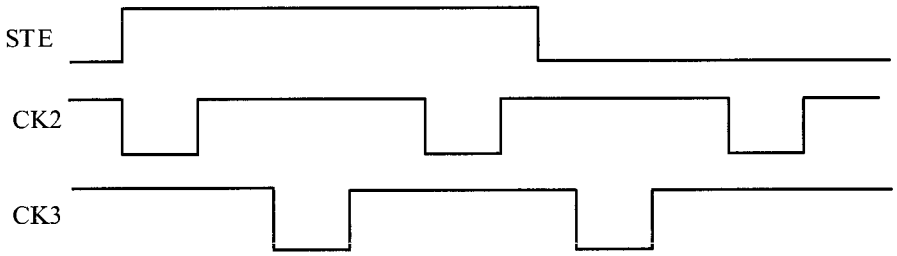
FIG. 6 illustrates a signal waveform diagram of input signals of the EOA SR according to an embodiment of the present disclosure.

A waveform diagram of the clock signal CK2 provided to the second clock signal input terminal, the clock signal CK3 provided to the third clock signal input terminal and the initiating signal STE provided to the initiating signal input terminal of the EOA SR is illustrated in FIG. 6. According to one embodiment, the clock signals CK2 and CK3 inputted to the second clock signal input terminal and the third clock signal input terminal are substantially identical in waveform with a predetermined phase offset. A duty ratio of the clock signal may be about 1:4. The initiating signal STE is a clock signal with greater cycles. In the present embodiment, the clock signals CK2 and CK3 have a phase difference of about ½ cycle.

In the present embodiment, the output terminal of each shift register unit of the light emitting driving unit 14 is coupled with the second terminal of the switch element of the light emitting switch unit 15, so as to provide a light emitting signal and a switch signal to the pixel array, respectively. When the first clock signal input terminal and the control signal input terminal of the switch element of the light emitting switch unit 15 are provided with a high level signals, the light emitting switch unit 15 is disabled, and the light emitting driving unit 14 is enabled to provide light emitting signal to the pixel array for progressive displaying. When the second clock signal input terminal, the third clock signal input terminal and the initiating signal input terminal of each shift register unit of the light emitting driving unit 14 are provided with high level signals, the light emitting driving unit 14 is disabled, and the light emitting switch unit 15 is enabled to provide a switch signal to the pixel array for simultaneous displaying.

In the present embodiment, the detailed steps for controlling the display device 100 to perform the progressive displaying or the simultaneous displaying include:

when the first clock signal input terminal and the control signal input terminal of the switch element are provided with high level, and the second clock signal input terminal, the third clock signal input terminal and the initiating signal input terminal of the shift register unit are provided with a level signal having a preset cycle, the scan driving unit inputs the scan signal to the pixel array progressively, the light emitting driving unit is turned on progressively, and the display device performs the progressive displaying; and when the first clock signal input terminal of the switch element is provided with a level signal having a preset cycle and the control signal input terminal is provided with low level, and the second clock signal input terminal, the third clock signal input terminal and the initiating signal input terminal of the shift register unit are provided with high level, the scan driving unit inputs the scan signal to the pixel array progressively, the light emitting driving unit is turned on simultaneously, and the display device performs the simultaneous displaying.

Figure 7:
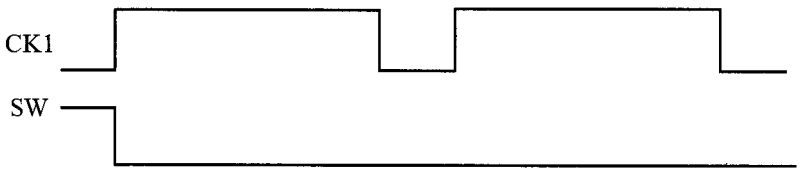
FIG. 7 illustrates a signal waveform diagram of input signals of the light emitting switch unit according to an embodiment of the present disclosure.

In the present embodiment, a waveform diagram of the clock signal CK1 provided to the first clock signal input terminal and the control signal SW provided to the control signal input terminal of the switch element of the light emitting switch unit 15 is illustrated in FIG. 7. In the present embodiment, by providing the light emitting switch unit 15, progressive displaying of the image is compatible with the simultaneous displaying of the image. When the clock signal CK1 and the control signal SW of the light emitting switch unit 15 are provided with high level and the signals STE/CKe1/CKe2 of the light emitting driving unit 14 are provided with the signals as illustrated in FIG. 6, progressive displaying of the image may be performed. When the clock signal CK1 and the control signal SW of the light emitting switch unit 15 are provided with the signals as illustrated in FIG. 7 and the signals STE/CKe1/CKe2 of the light emitting driving unit 14 are provided with high level, simultaneous displaying of the image may be performed. Accordingly, in the display device according to the present embodiment, the progressive displaying may be compatible with the simultaneous displaying.

Hereinafter, each operating period of the EOA SR is described with reference to the waveform diagram described above in FIG. 6.

(I) The First Period s1

Figure 8:
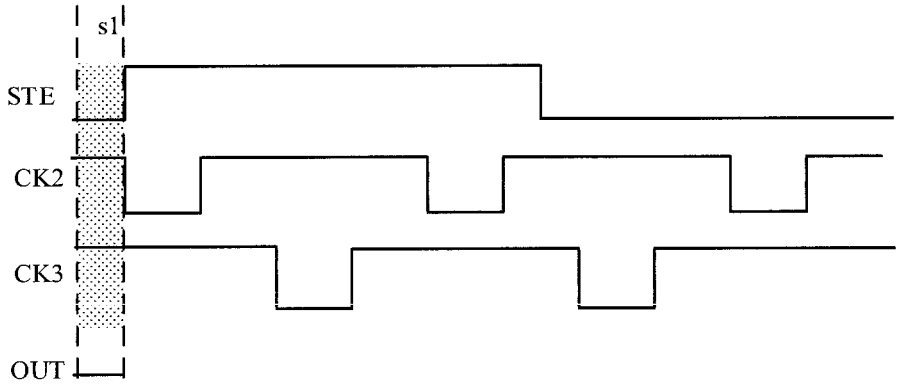
FIG. 8 illustrates a signal waveform diagram of input signals and output signals of the EOA SR during the first period according to an embodiment of the present disclosure.
Figure 9:
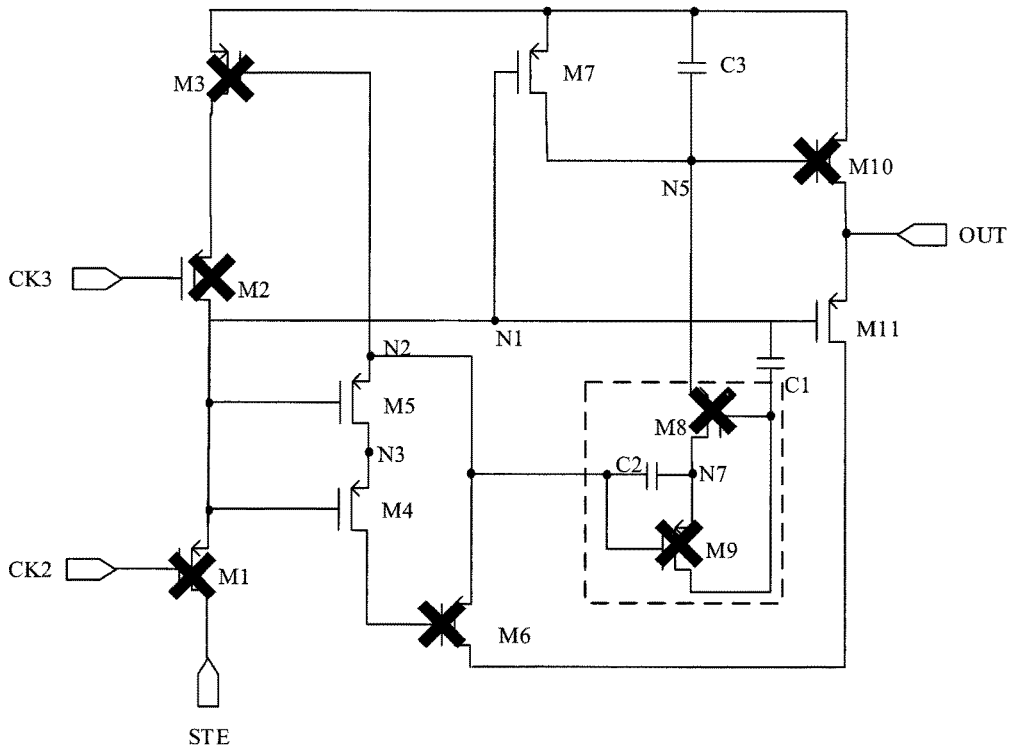
FIG. 9 is a schematic diagram of a circuit state of the EOA SR during the first period according to an embodiment of the present disclosure.

During this period, a waveform diagram of the signals is illustrated in FIG. 8. The initiating signal STE is at low level, and the clock signals CK2 and CK3 are at high level. A circuit diagram corresponding to this period is illustrated in FIG. 9, in which the first node N1 is at low level, the transistors M4, M5, M7 and M11 are turned on while the transistors M1, M2, M3, M6, M8, M9 and M10 are turned off, and meanwhile the output terminal OUT outputs low level, as illustrated in FIG. 8.

(II) The Second Period s2

Figure 10:
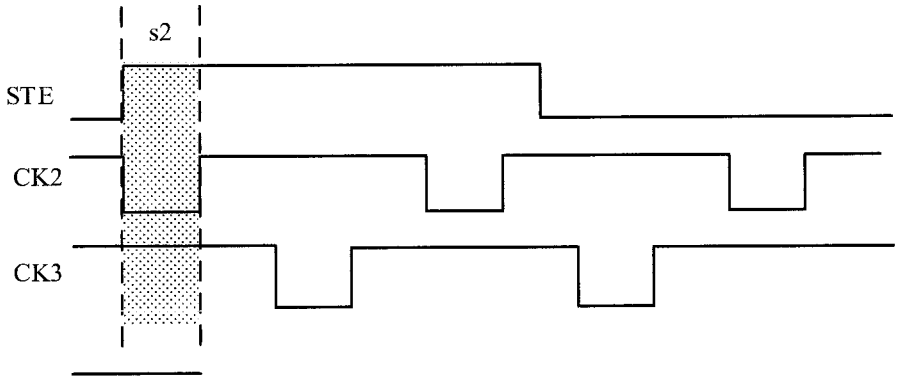
FIG. 10 illustrates a signal waveform diagram of input signals and output signals of the EOA SR during the second period according to an embodiment of the present disclosure.
Figure 11:
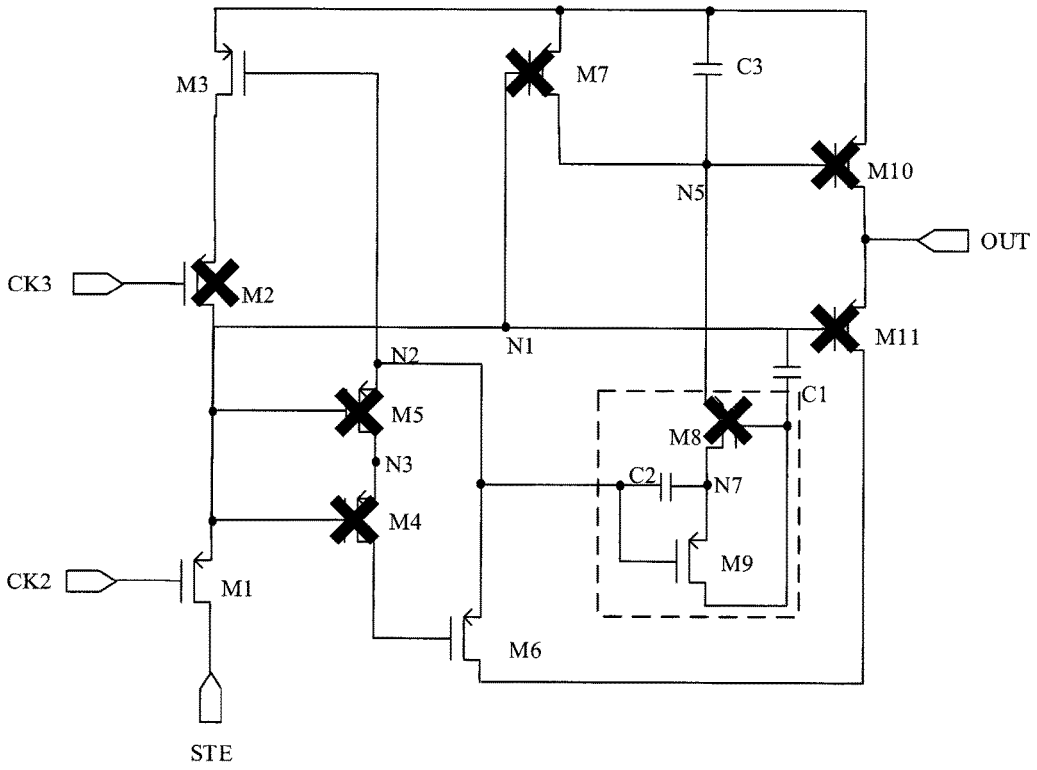
FIG. 11 is a schematic diagram of a circuit state of the EOA SR during the second period according to an embodiment of the present disclosure.

During this period, a waveform diagram of the signals is illustrated in FIG. 10. The initiating signal STE is at high level, the clock signal CK2 is at low level, and the clock signal CK3 is at high level. A circuit diagram corresponding to this period is illustrated in FIG. 11, in which the second node N2 is at low level, the transistors M3, M6 and M9 are turned on while the transistors M1, M2, M4, M5, M7, M8, M10 and M11 are turned off, and meanwhile the output terminal OUT is floated and continuously outputs low level, as illustrated in FIG. 10.

(III) The Third Period s3

Figure 12:
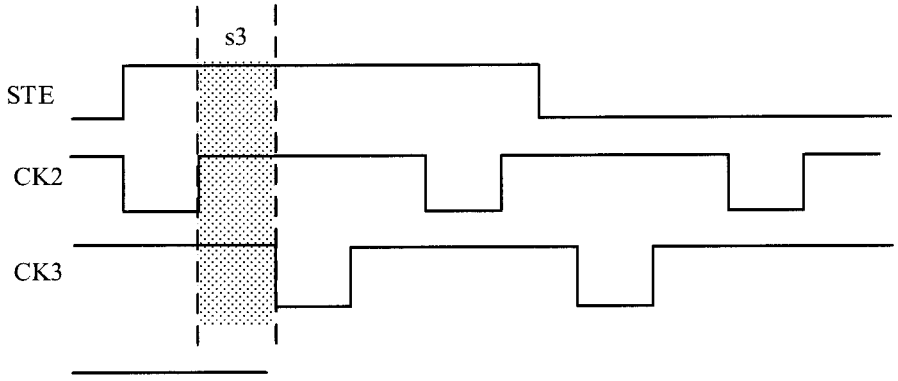
FIG. 12 illustrates a signal waveform diagram of input signals and output signals of the EOA SR during the third period according to an embodiment of the present disclosure.
Figure 13:
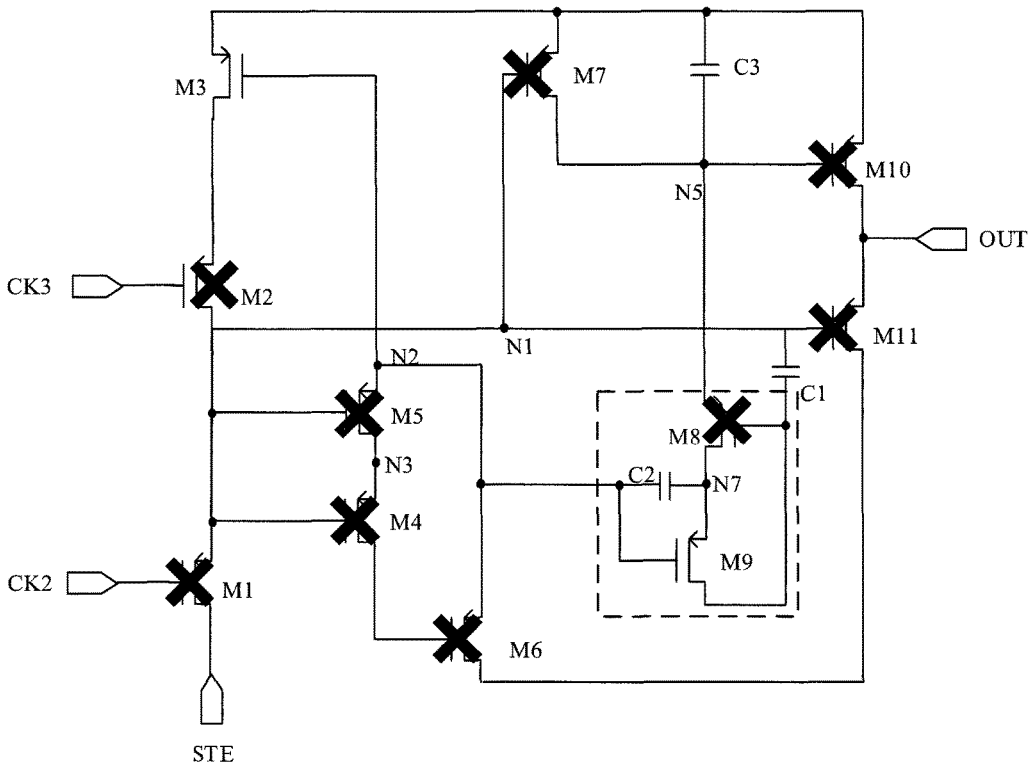
FIG. 13 is a schematic diagram of a circuit state of the EOA SR during the third period according to an embodiment of the present disclosure.

During this period, a waveform diagram of the signals is illustrated in FIG. 12. The initiating signal STE is at high level, and the clock signals CK2 and CK3 are at high level. A circuit diagram corresponding to this period is illustrated in FIG. 13, in which the second node N2 is at low level, the transistor M3 and M9 are turned on while the transistors M1, M2, M4-M8, M10 and M11 are turned off, and meanwhile the output terminal OUT is also floated and continuously outputs low level, as illustrated in FIG. 12.

(IV) The Fourth Period s4

Figure 14:
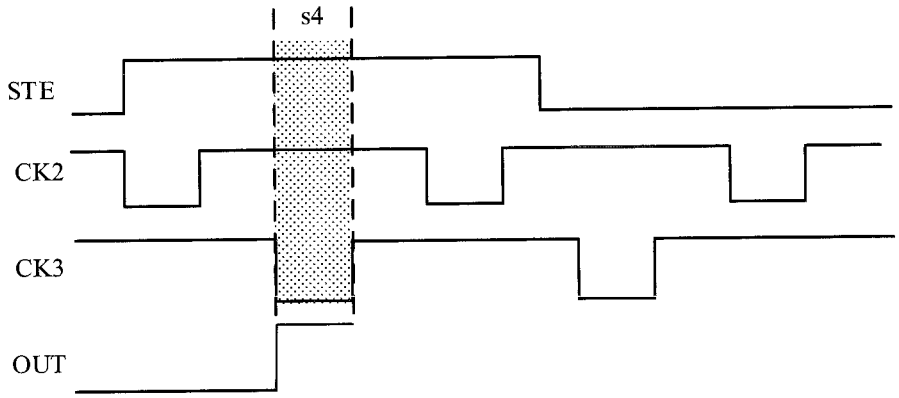
FIG. 14 illustrates a signal waveform diagram of input signals and output signals of the EOA SR during the fourth period according to an embodiment of the present disclosure.
Figure 15:
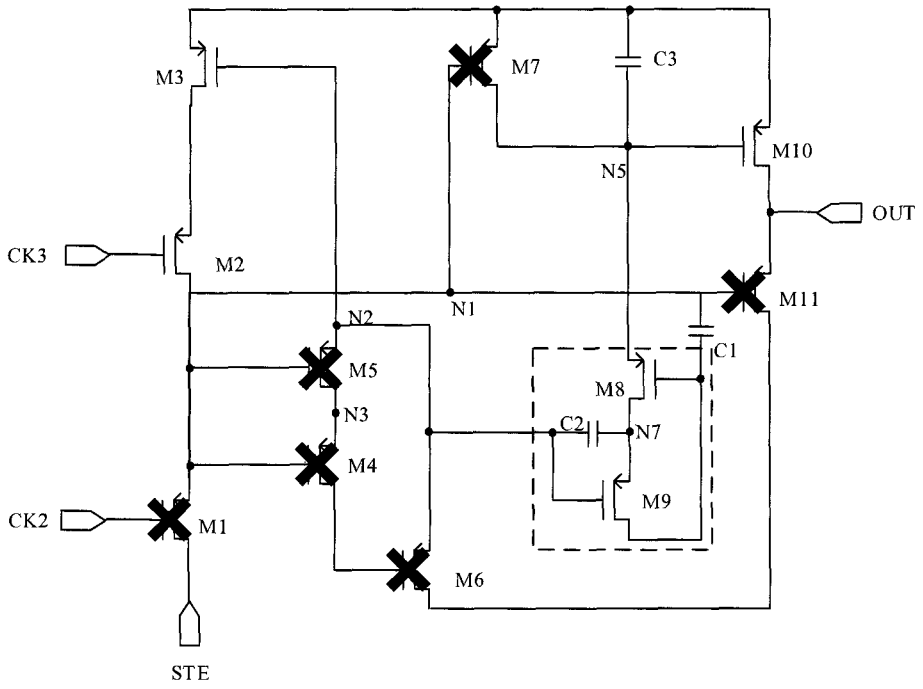
FIG. 15 is a schematic diagram of a circuit state of the EOA SR during the fourth period according to an embodiment of the present disclosure.

During this period, a waveform diagram of the signals is illustrated in FIG. 14. The initiating signal STE is at high level, the clock signal CK2 is at high level, and the clock signal CK3 is at low level. A circuit diagram corresponding to this period is illustrated in FIG. 15, in which the second node N2 and the fifth node N5 are at low level, the transistors M3, M8-M10 are turned on while the transistors M1, M2, M4-M7 and M11 are turned off, and meanwhile the output terminal OUT outputs high level, as illustrated in FIG. 14.

(V) The Fifth Period s5

Figure 16:
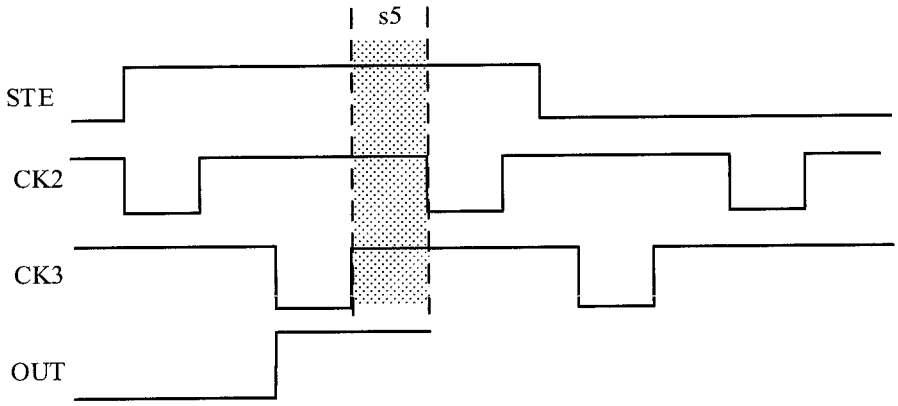
FIG. 16 illustrates a signal waveform diagram of input signals and output signals of the EOA SR during the fifth period according to an embodiment of the present disclosure.
Figure 17:
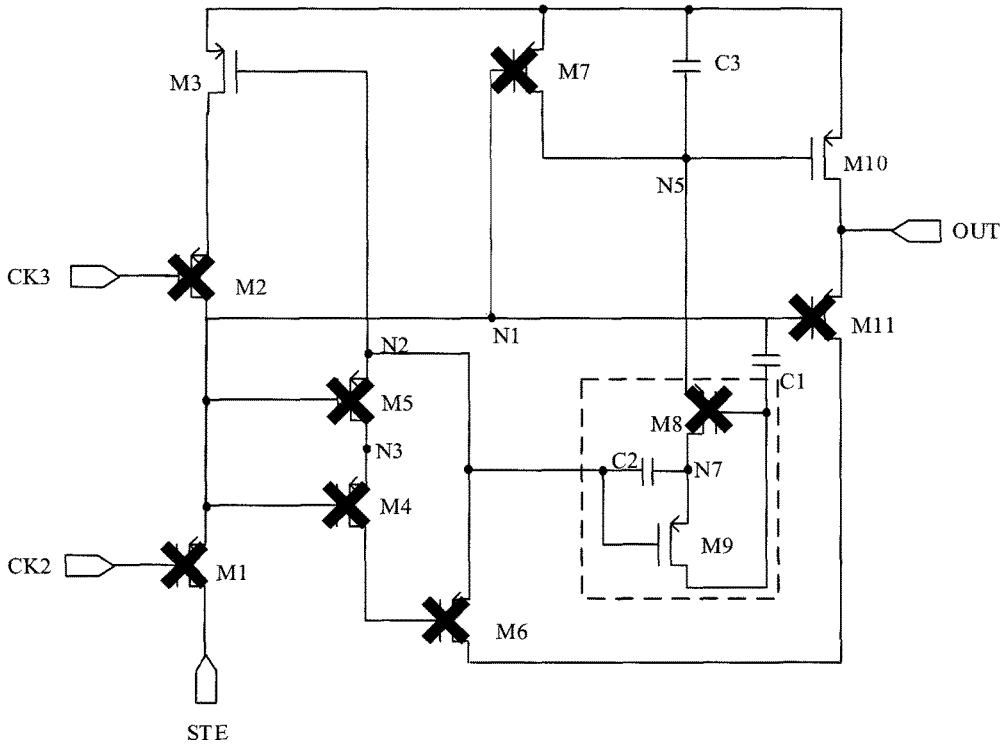
FIG. 17 is a schematic diagram of a circuit state of the EOA SR during the fifth period according to an embodiment of the present disclosure.

During this period, a waveform diagram of the signals is illustrated in FIG. 16. The initiating signal STE is at high level, and the clock signals CK2 and CK3 are at high level. A circuit diagram corresponding to this period is illustrated in FIG. 17, in which the second node N2 and the fifth node N5 are at low level, only the transistors M3, M9 and M10 are turned on while the transistors M1, M2, M4-M8 and M11 are turned off, and meanwhile the output terminal OUT also outputs high level, as illustrated in FIG. 16.

(VI) The Sixth Period s6

Figure 18:
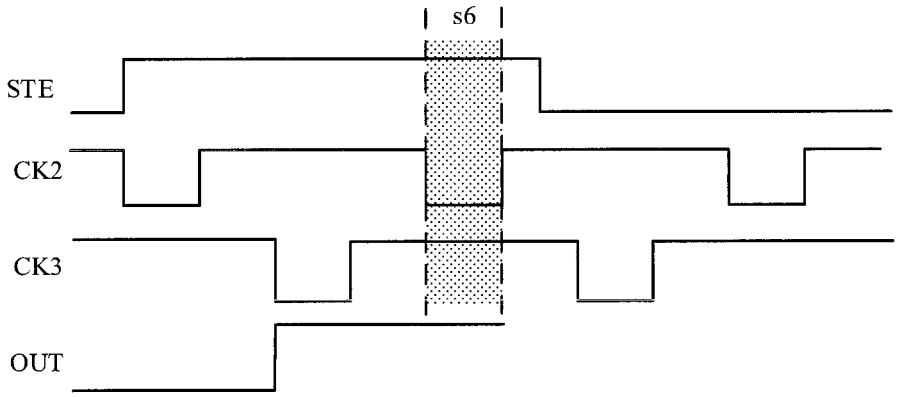
FIG. 18 illustrates a signal waveform diagram of input signals and output signals of the EOA SR during the sixth period according to an embodiment of the present disclosure.
Figure 19:
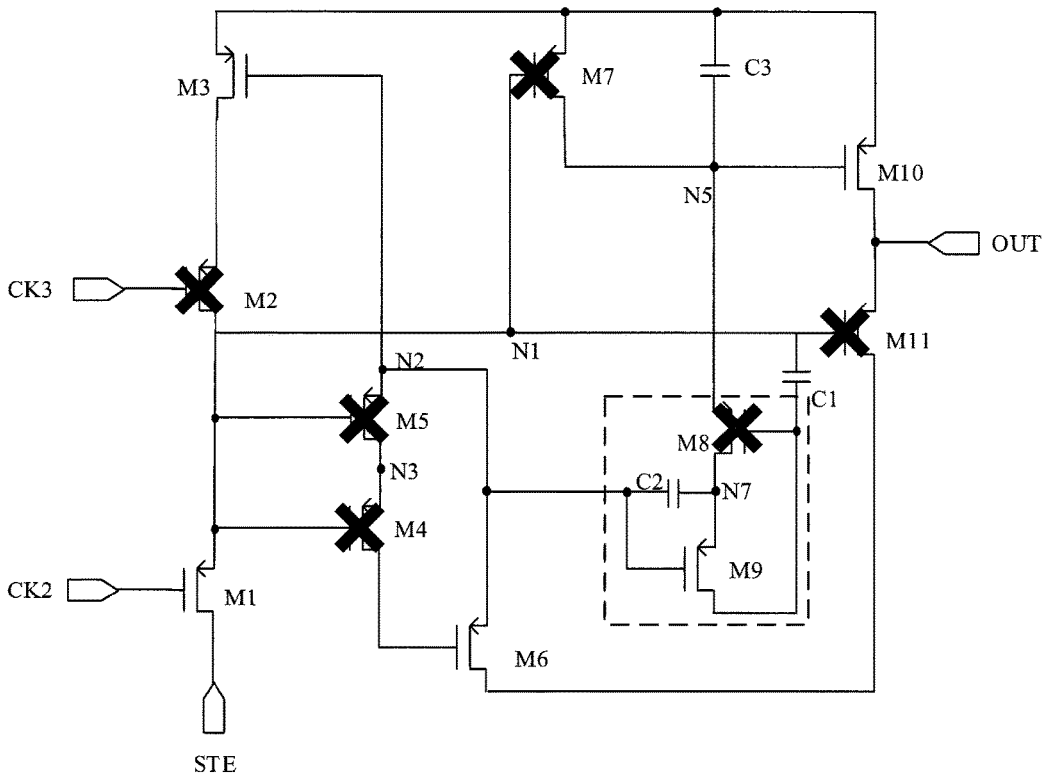
FIG. 19 is a schematic diagram of a circuit state of the EOA SR during the sixth period according to an embodiment of the present disclosure.

During this period, a waveform diagram of the signals is illustrated in FIG. 18. The initiating signal STE is at high level, the clock signal CK2 is at low level, and the clock signal CK3 is at high level. A circuit diagram corresponding to this period is illustrated in FIG. 19, in which the second node N2 and the fifth node N5 are at low level, the transistors M1, M3, M6, M9 and M10 are turned on while the transistors M2, M4-M5, M7-M8 and M11 are turned off, and meanwhile the output terminal OUT continuously outputs high level, as illustrated in FIG. 18.

(VII) The Seventh Period s7

Figure 20:
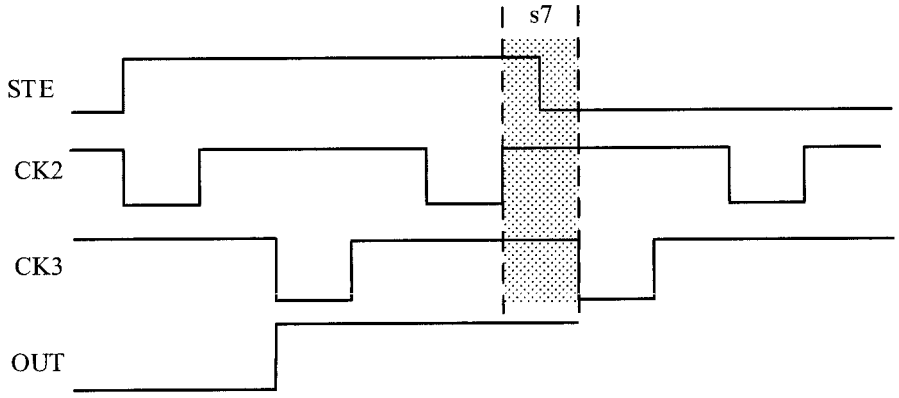
FIG. 20 illustrates a signal waveform diagram of input signals and output signals of the EOA SR during the seventh period according to an embodiment of the present disclosure.
Figure 21:
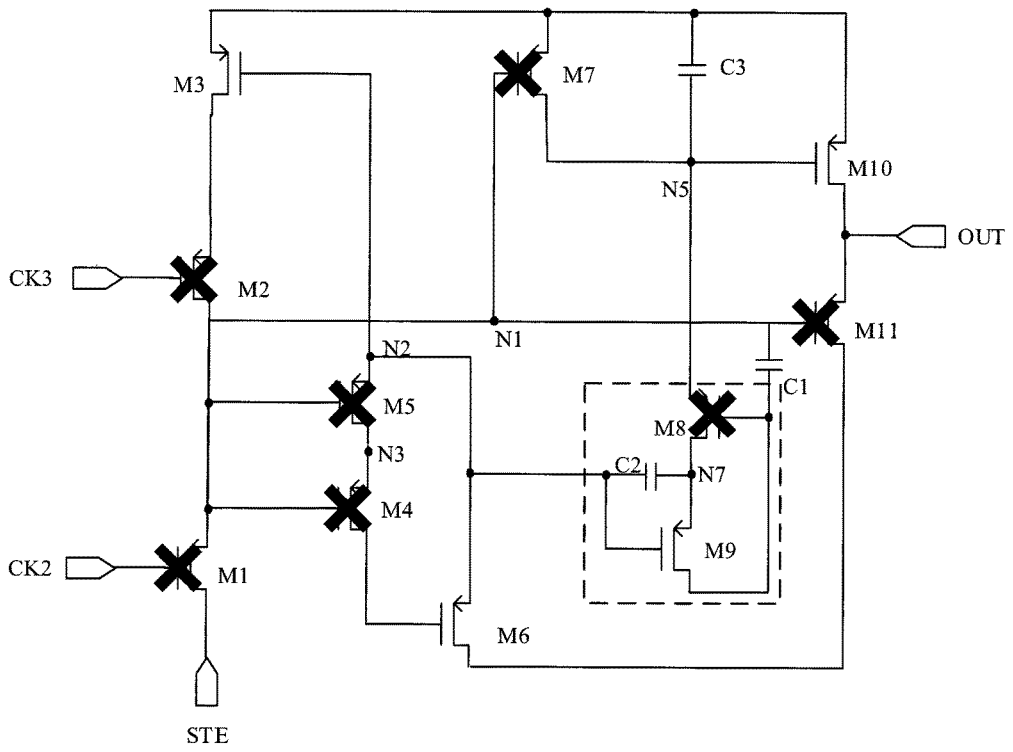
FIG. 21 is a schematic diagram of a circuit state of the EOA SR during the seventh period according to an embodiment of the present disclosure.

During this period, a waveform diagram of the signals is illustrated in FIG. 20. The initiating signal STE switches from high level to low level, and the clock signals CK2 and CK3 are at high level. A circuit diagram corresponding to this period is illustrated in FIG. 21, in which the second node N2 and the fifth node N5 are at low level, the transistors M3, M6, M9 and M1 are turned on while the transistors M1, M2, M4-M5, M7-M8 and M11 are turned off, and meanwhile the output terminal OUT continuously outputs high level, as illustrated in FIG. 20.

(VIII) The Eighth Period s8

Figure 22:
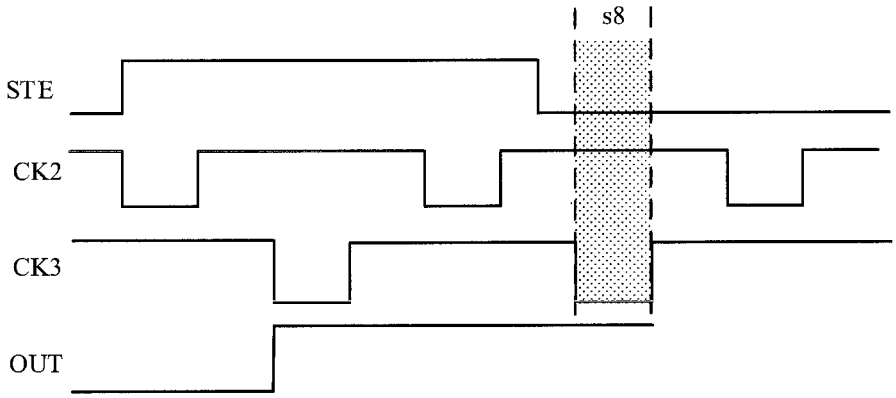
FIG. 22 illustrates a signal waveform diagram of input signals and output signals of the EOA SR during the eighth period according to an embodiment of the present disclosure.
Figure 23:
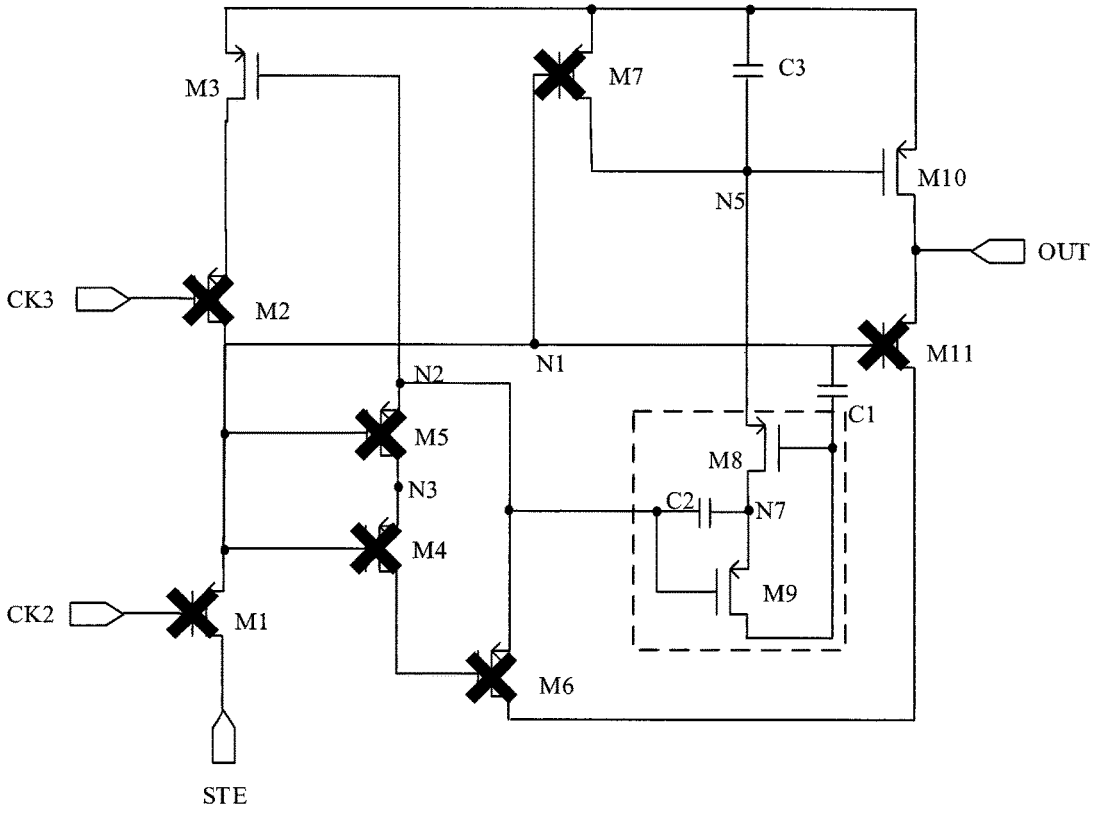
FIG. 23 is a schematic diagram of a circuit state of the EOA SR during the eighth period according to an embodiment of the present disclosure.

During this period, a waveform diagram of the signals is illustrated in FIG. 22. The initiating signal STE is at low level, the clock signal CK2 is at high level, and the clock signal CK3 is at low level. A circuit diagram corresponding to this period is illustrated in FIG. 23, in which the second node N2 and the fifth node N5 are at low level, the transistors M3, M9 and M10 are turned on while the transistors M1, M2, M4-M8 and M11 are turned off, and meanwhile the output terminal OUT continuously outputs high level, as illustrated in FIG. 22.

(IX) The Ninth Period s9

Figure 24:
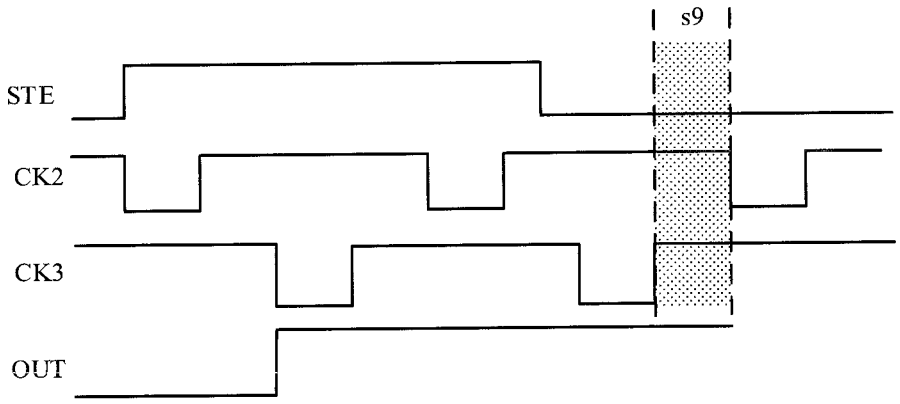
FIG. 24 illustrates a signal waveform diagram of input signals and output signals of the EOA SR during the ninth period according to an embodiment of the present disclosure.
Figure 25:
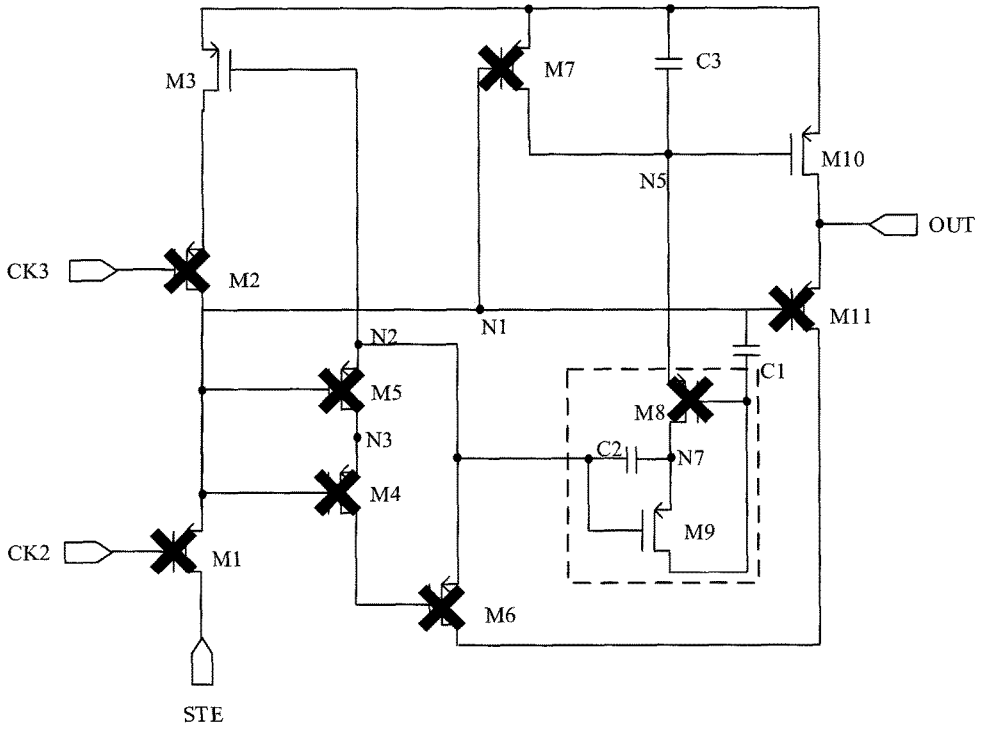
FIG. 25 is a schematic diagram of a circuit state of the EOA SR during the ninth period according to an embodiment of the present disclosure.

During this period, a waveform diagram of the signals is illustrated in FIG. 24. The initiating signal STE is at low level, and the clock signals CK2 and CK3 are at high level. A circuit diagram corresponding to this period is illustrated in FIG. 25, in which the second node N2 and the fifth node N5 are at low level, the transistors M3, M9 and M10 are turned on while the transistors M1, M2, M4-M8 and M11 are turned off, and meanwhile the output terminal OUT continuously outputs high level, as illustrated in FIG. 24.

(X) The Tenth Period s10

Figure 26:
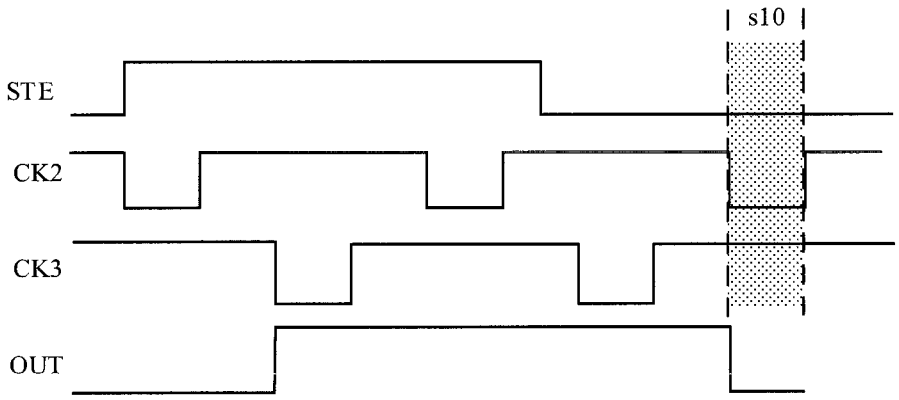
FIG. 26 illustrates a signal waveform diagram of input signals and output signals of the EOA SR during the tenth period according to an embodiment of the present disclosure.
Figure 27:
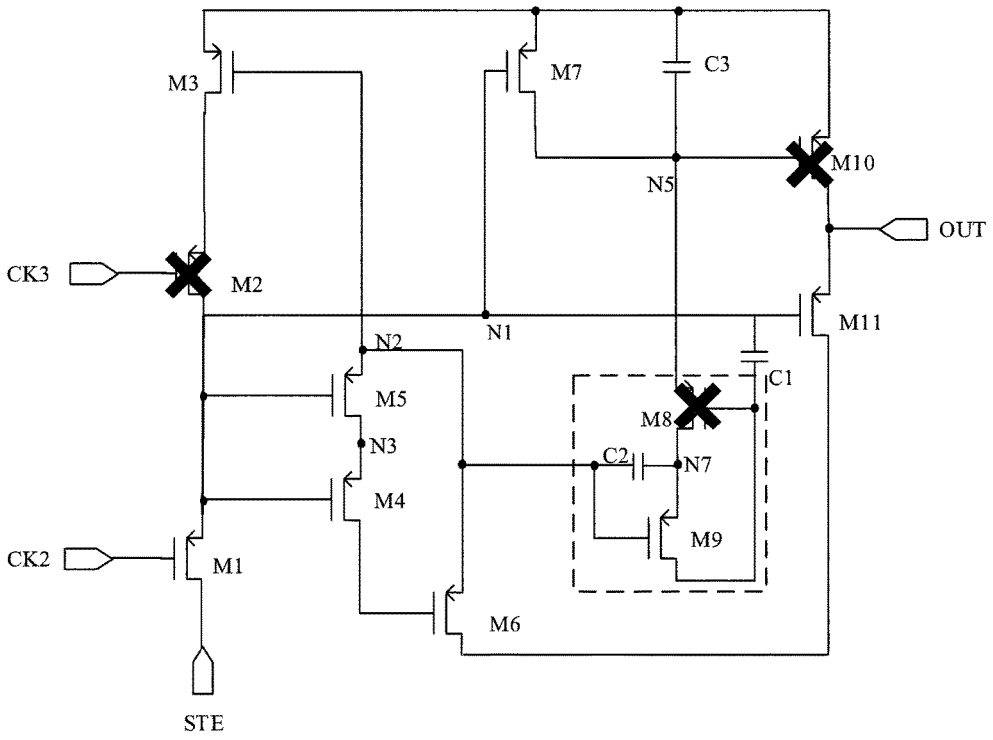
FIG. 27 is a schematic diagram of a circuit state of the EOA SR during the tenth period according to an embodiment of the present disclosure.

During this period, a waveform diagram of the signals is illustrated in FIG. 26. The initiating signal STE is at low level, the clock signal CK2 is at low level, and the clock signal CK3 is at high level. A circuit diagram corresponding to this period is illustrated in FIG. 27, in which the first node N1 and the second node N2 are at low level and the fifth node N5 is at high level, the transistors M1, M3-M7, M9 and M11 are turned on while the transistors M2, M8 and M10 are turned off, and meanwhile the output terminal OUT outputs low level, as illustrated in FIG. 26.

Afterwards, waveform diagrams corresponding to the above periods s1-s10 are repeated and circuit diagrams are also the same with those illustrated in FIGS. 8-27. In general, when the clock signal CK1 and the control signal SW are at high level, the EOA SR operates according to the above periods s1-s10 for progressive displaying. Generally, progressive displaying is used in a mobile device or PC (personal computer), while simultaneous displaying is used in VR (Virtual Real).

In conclusion, in the display device according to the present embodiment, a light emitting switch unit is further provided, and different level signals are provided from the light emitting driving unit and the light emitting switch unit. Accordingly, the display device is configured to perform progressive displaying or simultaneous displaying, such that the progressive displaying is compatible with the simultaneous displaying, and the user's demand of diversification is satisfied.

Figure 28:
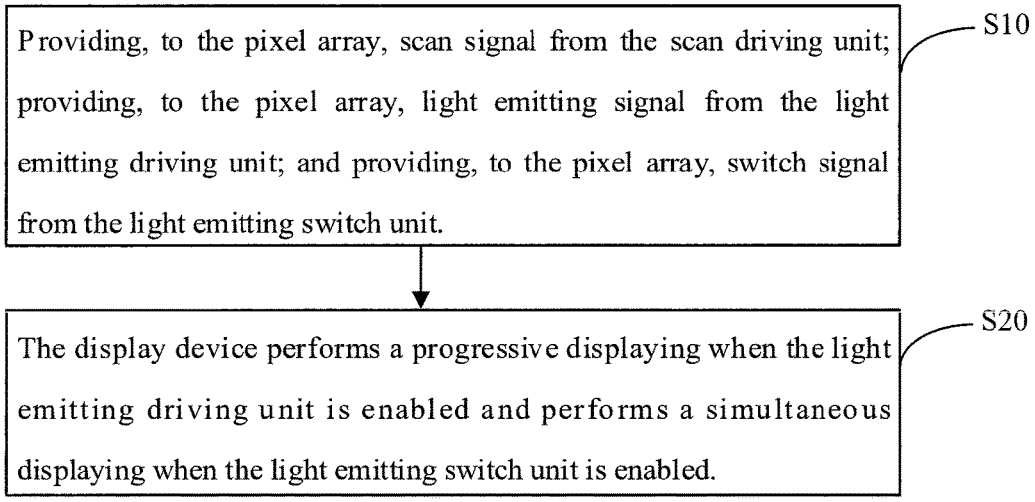
FIG. 28 is a flow chart diagram of steps of the method for controlling the display device according to another embodiment of the present disclosure.

FIG. 28 further illustrates a flow chart diagram of steps of the method for controlling the display device according to other embodiments of the present disclosure.

As illustrated in FIG. 28, in step S10, a scan signal is provided to the pixel array from the scan driving unit, a light emitting signal is provided to the pixel array from the light emitting driving unit, and a switch signal is provided to the pixel array from the light emitting switch unit.

As illustrated in FIG. 28, in step S20, when the light emitting driving unit is enabled, the display device performs the progressive displaying, and when the light emitting switch unit is enabled, the display device performs the simultaneous displaying.

According to one embodiment, in step S10, when the scan driving unit provides the scan signal to the pixel array, the scan signal is inputted progressively. That is, the scan signal is provided to one row of sub pixels in the pixel array, and the driving switches of the sub pixels in this row are turned on to write corresponding data signal. After finishing the writing of this row of data signal, the driving switches of the sub pixels in this row are turned off, and the driving switches of the sub pixels in the next row are turned on to write data signal in the same way.

According to the present embodiment, in step S20, when the first clock signal input terminal and the control signal input terminal of the switch element are provided with high level, and the second clock signal input terminal, the third clock signal input terminal and the initiating signal input terminal of the shift register unit are provided with a level signal having a preset cycle, the light emitting driving unit is turned on progressively, and the display device performs the progressive displaying, wherein the clock signals inputted to the second clock signal input terminal and the third clock signal input terminal are substantially identical in waveform with a predetermined phase offset. When the first clock signal input terminal of the switch element is provided with a level signal having a preset cycle and the control signal input terminal is provided with low level, and the second clock signal input terminal, the third clock signal input terminal and the initiating signal input terminal of the shift register unit are provided with high level, the light emitting driving unit is turned on simultaneously, and the display device performs the simultaneous displaying.

Accordingly, during the simultaneous displaying, when the scan driving unit is turned on progressively, the data signal is written progressively, and when the light emitting driving unit is turned on, the display device emits light simultaneously to perform the simultaneous displaying. During the progressive displaying, when the scan driving unit is turned on progressively, the data signal is written progressively, and under the control of the switch elements in the light emitting switch unit, the light emitting driving unit is turned on progressively, and the display device emits light progressively to perform the progressive displaying.

In conclusion, in the method for controlling the display device according to the present embodiment, the display device is configured to perform progressive displaying or simultaneous displaying by controlling the light emitting switch unit and providing different level signals from the light emitting driving unit and the light emitting switch unit, such that the progressive displaying is compatible with the simultaneous displaying, and the user's demand of diversification is satisfied.

Those skilled in the art should note that all the modifications and revisions without departing the scope and spirit disclosed in the appended claims of the present disclosure belong to the protection scope of the claims of the present disclosure.

What is claimed is:

1. A display device comprising a pixel array, wherein the display device further comprises:

a scan driving unit configured to provide a scan signal to the pixel array;

a light emitting driving unit configured to provide a light emitting signal to the pixel array; and a light emitting switch unit configured to provide a switch signal to the pixel array, wherein the display device performs a progressive displaying when the light emitting driving unit is enabled and performs a simultaneous displaying when the light emitting switch unit is enabled, and wherein the light emitting switch unit is disabled when the light emitting driving unit is enabled to provide light emitting signal to the pixel array for progressive displaying, and the light emitting driving unit is disabled when the light emitting switch unit is enabled to provide a switch signal to the pixel array for simultaneous displaying.

2. The display device according to claim 1, wherein the light emitting switch unit comprises a plurality of switch elements each of which comprises a first clock signal input terminal, a control signal input terminal and a first output terminal; and the light emitting driving unit comprises a plurality of cascade connected shift register units each of which comprises a second clock signal input terminal, a third clock signal input terminal, an initiating signal input terminal and a second output terminal, wherein the second output terminal is electrically coupled to the first output terminal.

3. The display device according to claim 2, wherein when the first clock signal input terminal and the control signal input terminal of the switch element are provided with high level, and the second clock signal input terminal, the third clock signal input terminal and the initiating signal input terminal of the shift register unit are provided with a level signal having a preset cycle, the scan driving unit inputs the scan signal to the pixel array progressively, the light emitting driving unit is turned on progressively, and the display device performs the progressive displaying.

4. The display device according to claim 3, wherein a clock signal inputted to the second clock signal input terminal and a clock signal inputted to the third clock signal input terminal are substantially identical in waveform with a predetermined phase offset.

5. The display device according to claim 2, wherein when the first clock signal input terminal of the switch element is provided with a level signal having a preset cycle and the control signal input terminal is provided with low level, and the second clock signal input terminal, the third clock signal input terminal and the initiating signal input terminal of the shift register unit are provided with high level, the scan driving unit inputs the scan signal to the pixel array progressively, the light emitting driving unit is turned on simultaneously, and the display device performs the simultaneous displaying.

6. A method for controlling a display device, the display device comprising a pixel array, the method comprising:

providing a scan signal from a scan driving unit to the pixel array;

providing a light emitting signal from a light emitting driving unit to the pixel array; and providing a switch signal from a light emitting switch unit to the pixel array, wherein the display device performs a progressive displaying when the light emitting driving unit is enabled and performs a simultaneous displaying when the light emitting switch unit is enabled, and wherein the light emitting switch unit is disabled when the light emitting driving unit is enabled to provide light emitting signal to the pixel array for progressive displaying, and the light emitting driving unit is disabled when the light emitting switch unit is enabled to provide a switch signal to the pixel array for simultaneous displaying.

7. The method according to claim 6, wherein the light emitting switch unit comprises a plurality of switch elements each of which comprises a first clock signal input terminal, a control signal input terminal and a first output terminal; and the light emitting driving unit comprises a plurality of cascade connected shift register units each of which comprises a second clock signal input terminal, a third clock signal input terminal, an initiating signal input terminal and a second output terminal, wherein the second output terminal is electrically coupled to the first output terminal.

8. The method according to claim 7, wherein a clock signal inputted to the second clock signal input terminal and a clock signal inputted to the third clock signal input terminal are substantially identical in waveform with a predetermined phase offset.

9. The method according to claim 8, wherein when the first clock signal input terminal and the control signal input terminal of the switch element are provided with high level, and the second clock signal input terminal, the third clock signal input terminal and the initiating signal input terminal of the shift register unit are provided with a level signal having a preset cycle, the light emitting driving unit is turned on progressively, and the display device performs the progressive displaying.

10. The method according to claim 8, wherein when the first clock signal input terminal of the switch element is provided with a level signal having a preset cycle and the control signal input terminal is provided with low level, and the second clock signal input terminal, the third clock signal input terminal and the initiating signal input terminal of the shift register unit are provided with high level, the light emitting driving unit is turned on simultaneously, and the display device performs the simultaneous displaying.

* * * * *